US007947935B2

(12) United States Patent
Lee

(10) Patent No.: US 7,947,935 B2
(45) Date of Patent: May 24, 2011

(54) MICROWAVE OVEN AND LATCH BOARD IN THE MICROWAVE OVEN

(75) Inventor: Sang Ryul Lee, Masan-si (KR)

(73) Assignee: LG Electronics Inc., Seoul (KR)

( * ) Notice: Subject to any disclaimer, the term of this patent is extended or adjusted under 35 U.S.C. 154(b) by 1104 days.

(21) Appl. No.: 10/575,858

(22) PCT Filed: Oct. 15, 2004

(86) PCT No.: PCT/KR2004/002636

§ 371 (c)(1),
(2), (4) Date: Feb. 15, 2007

(87) PCT Pub. No.: WO2005/038351

PCT Pub. Date: Apr. 28, 2005

(65) Prior Publication Data

US 2007/0235449 A1 Oct. 11, 2007

(30) Foreign Application Priority Data

Oct. 16, 2003 (KR) ..... 10-2003-0072125

(51) Int. Cl.
*H05B 6/68* (2006.01)
*H05B 6/80* (2006.01)

(52) U.S. Cl. ..... 219/722; 219/739; 219/715

(58) Field of Classification Search ..... 219/739, 219/722, 715, 702, 723, 724, 716; 126/197; 200/50.12, 50.13
See application file for complete search history.

(56) References Cited

U.S. PATENT DOCUMENTS 6,521,875 B1 * 2/2003 Kim et al. ..... 219/715
2004/0182856 A1 * 9/2004 Lee et al. ..... 219/739

FOREIGN PATENT DOCUMENTS

CN 88 1 02377 11/1988
KR 2000-0031906 6/2000

OTHER PUBLICATIONS

Chinese Office Action dated May 8, 2009.
Australian Office Action dated Jun. 7, 2007.

* cited by examiner

*Primary Examiner* — Quang T Van
(74) *Attorney, Agent, or Firm* — Ked & Associates LLP

(57) ABSTRACT

A latch board of a microwave oven is provided. The latch board includes a first lever for controlling on/off operation of a monitor switch. The first lever is formed in an approximate triangular shape and has a hinge formed at a first edge, a pressing part formed at a second edge to come in contact with the monitor switch, and a protrusion part formed at a third edge to come in contact with the latch more rapidly. In the latch board, a difference in operation time of the monitor switch and the circuit switch can be increased such that the operation stability of the microwave oven is improved.

13 Claims, 3 Drawing Sheets

MICROWAVE OVEN AND LATCH BOARD IN THE MICROWAVE OVEN

TECHNICAL FIELD

The present invention relates to a microwave oven, and more particularly, to a latch board of a microwave oven in which a microwave oven can operate more stably by increasing a difference in operation time of a monitor switch and a circuit switch.

BACKGROUND ART

Generally, a microwave oven is a device that is used to heat food by radiating microwave generated from a magnetron to the food when electric current is applied to electric components of the device. Such a microwave oven is classified into a household microwave oven having a small magnetron and a commercial microwave oven having a large (or a plurality of) magnetron(s).

The microwave oven is further classified according to a heating method into a glass tray method rotating the food and a stirrer fan method scattering microwave radiated into the cavity. The former is generally applied to the household microwave oven while the latter is applied to the commercial microwave oven. Meanwhile, since the commercial microwave oven is generally used at convenience stores where the microwave oven is frequently used and restaurants where a large amount of the food should be quickly heated, the commercial microwave oven needs relatively high power output compared with the household microwave oven.

Since the microwave oven cooks the foods by radiating the high power microwave into a cavity, it should be careful so that the microwave cannot be radiated when a door is in an opened state. If the microwave is radiated when the door is in the opened state, a fatal accident threatening user's safety may be caused.

In order to control the radiation of the microwave depending on the opened/closed state of the door in the microwave oven, a latch is provided at an inside of the door of the microwave oven and a latch board is provided at a front side of the microwave oven. An operation of the latch board is controlled by the latch. In more detail, the latch board fixes the latch such that an automatic opening of the door is prevented. Also, when the latch is inserted and locked into the latch board, the closing of the door is correctly detected and the operations of the magnetron and the microwave oven are controlled.

An operation of the latch board will now be described in brief. A motor switch and a circuit switch are provided on the latch board. The circuit switch is provided with one primary switch and one secondary switch. The monitor switch controls the on/off operation of the monitor of the microwave oven and the circuit switch controls the on/off operation of other drive circuits, including the magnetron, of the microwave oven.

Meanwhile, the switch performs the on/off operation in association with the insertion of the latch. That is, when the latch is inserted, the monitor switch is first turned off and the circuit switch is then turned on at predetermined time interval. Specifically, when the monitor switch is first turned off and the circuit switch is then turned on, a predetermined time difference occurs between the two switches. It aims to prevent the voltage applied to the primary switch from directly flowing through the secondary switch.

In the related art latch board, however, the time difference between the on/off of the monitor switch and the on/off of the circuit switch is short. Thus, the voltage applied to the primary switch frequently flows through the secondary switch directly, so that the circuit is shorted. Like this, if the circuit is shorted, a fuse is disconnected such that the microwave cannot be used any more until after service. Therefore, there is a demand for a latch board structure that can increase the difference in operation time of the monitor switch and the circuit switch.

DISCLOSURE

Technical Problem

Accordingly, the present invention is directed to a latch board structure of a microwave oven that substantially obviates one or more of the problems due to limitations and disadvantages of the related art.

An object of the present invention is to provide a latch board of a microwave oven, capable of increasing a difference in operation time of a monitor switch and a circuit switch.

Also, another object of the present invention is to provide a latch board structure of a microwave oven, capable of making the microwave oven operate stably through a stable switching operation of a switch in opening/closing a door.

Technical Solution

To achieve these and other advantages and in accordance with the purpose of the present invention, as embodied and broadly described, there is provided a microwave oven including: a cavity into which food is loaded; a door for opening/closing a front side of the cavity; at least one latch formed at an inner side of the door; a latch board for supporting the latches when the latch is inserted thereinto; a monitor switch and a circuit switch, provided on the latch board, for performing on/off operation to control the microwave oven; a first lever having one end contacting with the monitor switch and the other end contacting with the latch, the first lever rotating to turn on/off the monitor switch; a second lever having one end contacting with the circuit switch and the other end contacting with the latch, the second lever rotating to turn on/off the circuit switch; and a protrusion part formed at a periphery of the first lever and protruded from a portion with which the latch comes in contact, such that if the latch is inserted, the monitor switch operates before the circuit switch, and if the latch is released, the monitor switch operates after the circuit switch.

In another aspect of the present invention, there is provided a latch board of a microwave oven, including; a monitor switch including a monitor button operated by a first lever, an internal contact point of the monitor switch being on/off by the monitor button; a circuit switch including a circuit button operated by a second lever, an internal contact point of the circuit switch being on/off by the circuit button; a first lever hinge for hingedly fixing the first lever; a second lever hinge for hingedly fixing the second lever; and a protrusion part protruded from one side of the first lever in an inserting direction of a latch.

In a further another aspect of the present invention, there is provided a latch board of a microwave oven, including: an inserting hole into which a latch is inserted, the latch being formed at an inner side of a door; a plurality of levers provided inside the inserting hole; and a plurality of switches, selectively coming in contact with the lever and the latch, for controlling on/off operation of the microwave oven, the switches including a monitor switch, wherein the plurality of levers include a first lever for controlling on/off operation of the monitor switch, the first lever being formed in an approximate triangular shape and having a hinge formed at a first edge, a pressing part formed at a second edge to come in contact with the monitor switch, and a protrusion part formed at a third edge to come in contact with the latch more rapidly.

Advantageous Effects

According to the present invention, a difference in operation time of a monitor switch and a circuit switch can be increased when a door is opened. Also, due to the increase of the difference in operation time, the circuit stability of the microwave oven is secured such that the microwave oven can be used more stably for a long time.

In addition, a latch board can be configured with a simple mechanical structure.

BEST MODE

Hereinafter, a latch board of a microwave oven according to the present invention will be described in detail with reference to the accompanying drawings.

Figure 1:
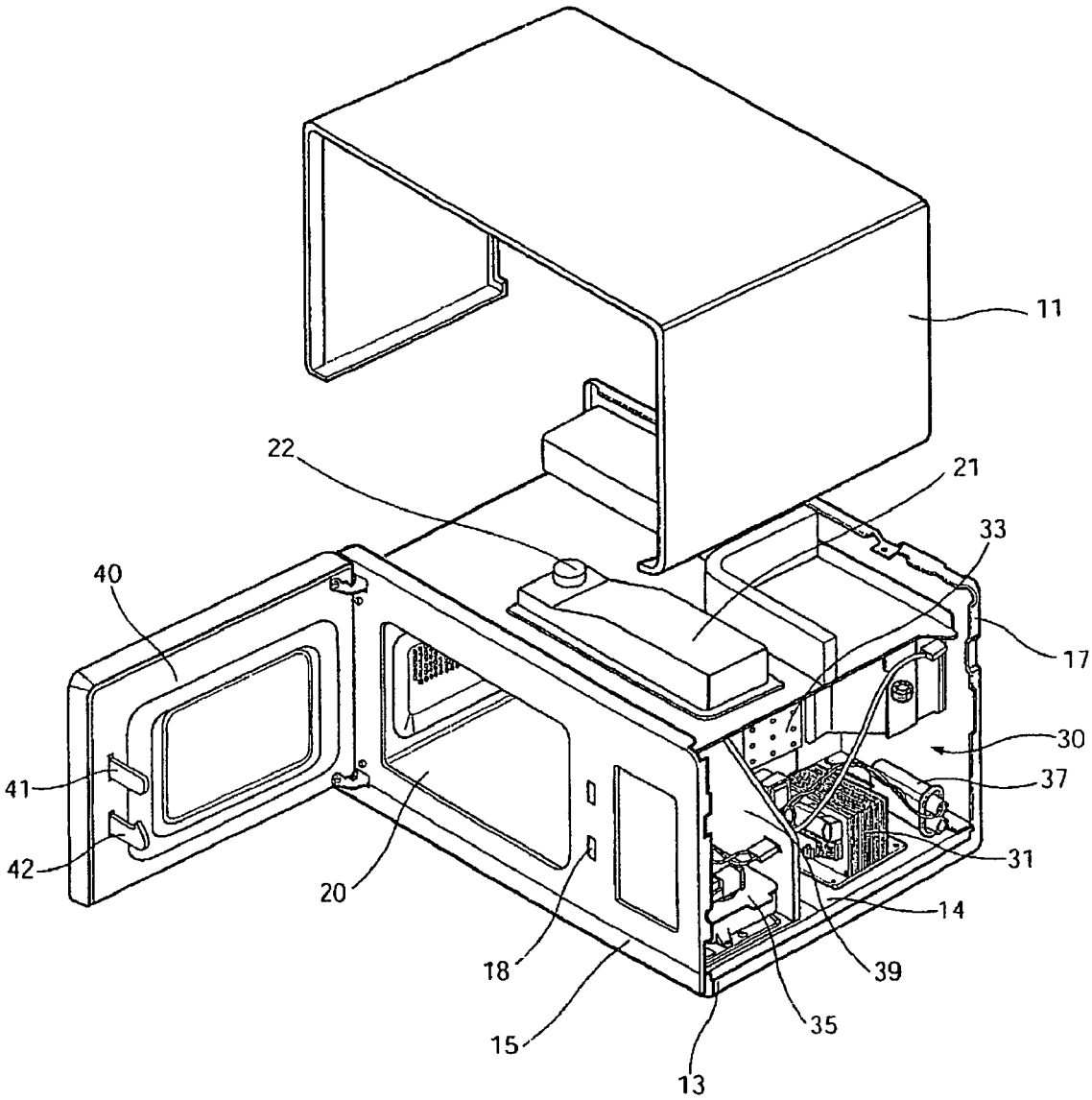
FIG. 1 is an exploded perspective view of a microwave oven according to the present invention.

FIG. 1 is an exploded perspective view of a microwave oven according to the present invention. A structure of the microwave oven according to the present invention will now be described in detail with reference to FIG. 1.

A microwave oven according to the present invention includes an outer case defining an outer appearance, a cavity 20 into which food is loaded, and an electric component chamber 30 receiving a plurality of electric components. Also, the microwave oven further includes a door 40 installed in a front side of the cavity 20 and a latch board (100 in FIG. 2) installed in a rear side of a front plate 15.

A structure and operation of the respective elements will now be described in detail.

The outer case defines the outer appearance of the microwave oven and protects the cavity 20 installed therein. Accordingly, it is preferable that the outer case is formed of a steel plate having a predetermined strength. The outer case 11 is installed around the cavity 20 and includes an upper plate 11 covering a top and both sides of the cavity 20, a base plate 13 protecting a bottom of the cavity 20, a front plate 15 defining a front portion of the cavity 20, and a back plate 17 protecting a rear side of the cavity 20.

Specifically, a latch hole 18 is perforated at a right side of the front plate 15. A latch, which will be described later, is inserted into the latch hole 18. Also, a latch board (100 in FIG. 2) is installed at a rear side of the latch hole 18, in more detail at a rear side of the front plate 15. The latch board fixes the latch and performs a switching operation of controlling the on/off of the microwave oven by means of the latch.

The cavity 20 is a space where food is heated and is formed in a rectangular box shape having a front opening. The food is loaded into and unloaded from the cavity 20 through the front opening. The front opening is opened and closed by the door 40. A waveguide 21 for guiding the microwave generated by a magnetron into the cavity 20 is mounted on an outer upper surface of the cavity 20. A motor 22 for driving a stirrer fan is installed at a side of the waveguide 21.

The waveguide 21 may be installed on both an outer upper surface and an outer lower surface of the cavity 20. In this case, the microwave is radiated upward and downward in the cavity 20. That is, the microwave is radiated throughout the inner space of the cavity 20, thereby making the food cooked evenly.

The electric component chamber 30 is a space defined at an inner right side of the outer case and receives a plurality of electric components for driving the microwave oven. A transformer 31, a magnetron 33, a blower fan 35, a capacitor 37 are installed inside the electric component chamber 30. A barrier 39 is disposed inside the electric component chamber 30, that is, between the transformer 31 and the blower fan 35. The transformer 31, the blower fan 35, the capacitor 37 and the barrier 39 are fixed to the upper surface of a sub-plate 14. The sub-plate 14 is installed spaced apart from the upper surface of the base plate 13 by a predetermined distance.

Among the electric components, the transformer 31 and the magnetron 33 generate the microwave radiated into the cavity 20. In the course of this process, the electric components are heated to increase the internal temperature of the electric component chamber 30 during heating the food. In order to cool down the heated electric components, an outer air must be introduced into the electric component chamber 30. The air introduction is achieved by the blower fan 35.

A flat latch 41 and a hook latch 42 are protrusively formed at an inner side of the door 40, which is installed in the front side of the cavity 20. The flat latch 41 and the hook latch 42 are inserted into the latch board (100 in FIG. 2) through the latch hole 18. The latch board 100 fixes the latches 41 and 42 such that the self-opening of the door can be prevented. A plurality of switches are further provided to detect the insertion of the latches 41 and 42 and control the operating state of the microwave oven.

Figure 2:
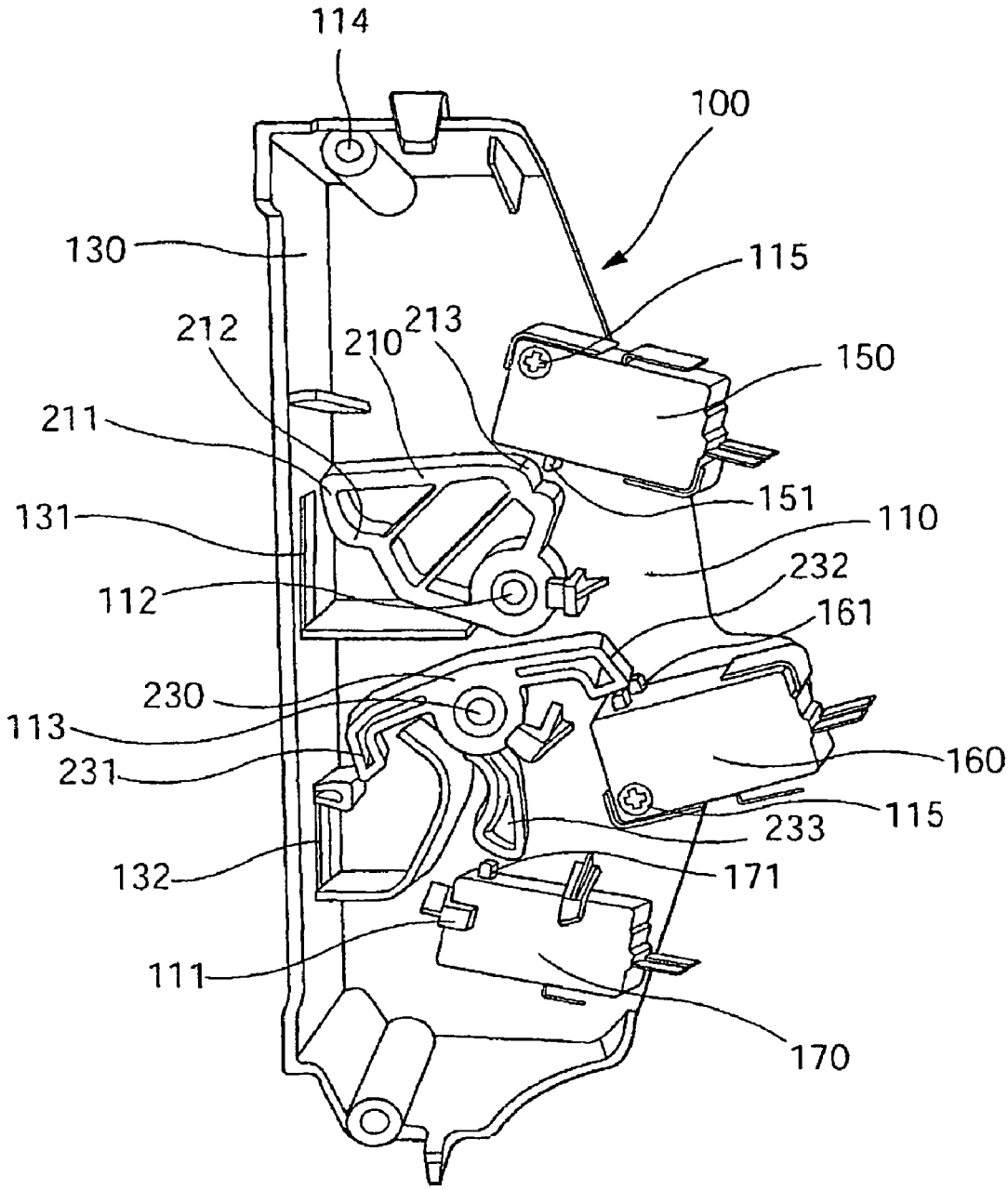
FIG. 2 is a perspective view of a latch board according to the present invention.

A structure of the latch board 100 will now be described in detail. FIG. 2 is a perspective view of the latch board.

Referring to FIG. 2, the latch board 100 according to the present invention includes a base part 110, a tight contact part 130, a plurality of switches 150, 160 and 170. The base part 110 forms a bottom surface of the latch board 100. The tightly contacting part 130 is formed at one end of the base part 110 and tightly contacts the latch board 100 with the front plate 15. The plurality of switches 150, 160 and 170 are formed at an inside of the base part 110.

The respective elements installed in the latch board 100 will now be described in detail.

First, the base part 110 forms a backbone of the latch board 100. The plurality of switches 150, 160 and 170 and levers 210 and 230 are provided at an inside of the base part 110. The levers 210 and 230 operate the switches 150, 160 and 170. In more detail, a plurality of fixing protrusions 111 and hinges 112 and 113 are protrusively formed around a rotational center axis of the levels 210 and 230 in the inside of the base part 110. The fixing protrusions 111 fix the switches, and the hinges 112 and 113 hingedly fix the levers 210 and 230. Coupling holes 114 for fixing the latch board 100 to a rear side of the front plate 15 are formed on upper and lower ends of the base part 110.

Also, the tight contacting part is tightly contacted with the rear side of the front plate 15, such that the latch board 100 is tightly fixed to the rear side of the front plate 15. A flat latch inserting opening 131 and a hook latch inserting opening 132 are perforated at an approximate middle portion of the tight contacting part 130. The flat latch 41 and the hook latch 42 of the door are inserted into the flat latch inserting opening 131 and the hook latch inserting opening 132, respectively.

A monitor switch 150 is fixed on an inner upper portion of the base part 110 by a screw 115. The monitor switch 150 is a kind of a contact switch that performs on/off operations and has a monitor button 151 that is disposed at a lower portion and operated by a first lever, which will be described later. Also, a primary switch 160 and a secondary switch 170 are provided at a portion spaced downward from the monitor switch 150 and are fixed by the screw 155 and the fixing protrusion 111, respectively. The circuit switches 160 and 170 are contact switches that perform on/off operations and have circuit buttons 161 and 171 that are disposed at upper portions and operated by a second lever, which will be described later.

In addition, the first lever 210 and the second lever 230 are fixed to the hinges 112 and 113 of the base part 110. One side of the first lever 210 is hingedly fixed to the hinge 112 and one side of the second lever 230 is hingedly fixed to the hinge 113. Thus, the first and second levers 210 and 230 rotate around the hinges 112 and 113. Elastic members (not shown) for directing the rotational directions of the levers 210 and 230 may be connected to the hinges 112 and 113. The first and second levers 210 and 230 are pushed by the flat latch 41 and the hook latch 42 inserted through the latch inserting openings 131 and 132 and perform the rotational motion. Specifically, since a protrusion 211 is formed at a front end of the lever 210, the first lever 210 can rotate faster when the flat latch 41 is inserted. Also, the first lever 210 can rotate slower when the flat latch 41 is released. Of course, the rotational motion of the first lever 210 is associated with the or/off of the monitor button 151. Thus, if the first lever 210 rotates faster, the monitor button 151 also performs the on/off operation faster. If the first lever 210 rotates slower, the monitor button 151 also rotates slower.

Figure 3:
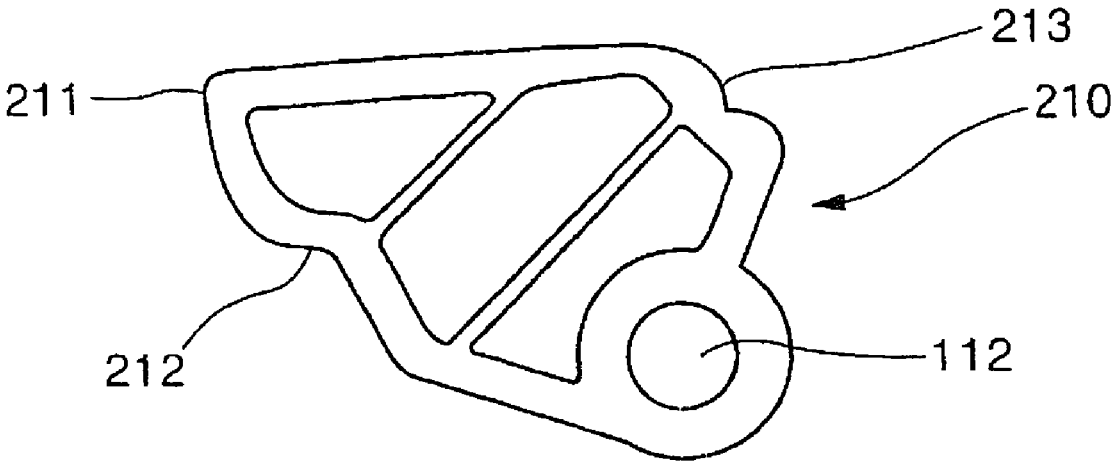
FIG. 3 is a plan view of a first lever applied to the latch board.

FIG. 3 is a plan view of the first lever shown in FIG. 1. A structure of the first lever 210 will now be described in detail with reference to FIG. 3. When the door is opened/closed, the protrusion 211 urges the first lever 210 upward much faster due to the flat latch 41. Although it is most preferable that the protrusion 211 be integrally formed with the first lever 210, an additional member may be attached to one side of the first lever 210.

Also, an inclined part 212 having a predetermined slope is formed at a lower portion of the protrusion 211. If the door is opened, the inclined part 212 delays time necessary when the lever 210 is returned downward. In more detail, even when the first lever 210 is released by a predetermined distance, the first lever 210 can be firmly fixed because the position of the first lever 210 is supported in the upper direction. A pressing part 213 is formed at an upper portion of the first lever 210 and presses the monitor button 151 of the monitor switch 150. Like this, as the first lever 210 is rotated in a clockwise direction due to the first lever, the pressing part 213 presses the monitor button 151.

Alternatively, the first lever 210 may be formed in a shape of a triangular flat plate. A hinge 112 is formed at one edge and is operated around a rotational center of the first lever 210. A pressing part 213 is formed at another edge and comes into contact with the monitor button 151. A protrusion 211 and an inclined part 212 are formed at a further another edge. The protrusion 211 comes in contact with the flat latch 41 and the inclined part 212 is extended from the protrusion 211. If the flat latch 41 is inserted, an insertion end portion of the flat latch 41 first comes in contact with the protrusion 211. Therefore, the first lever 210 rotates around the hinge 112 in a clockwise direction and the pressing part 213 comes in contact with the monitor button 151, such that the monitor switch 150 is operated. Then, the first lever 210 is rotated by more than a predetermined angle and comes in contact with the inclined part 212. Therefore, even if the flat latch 41 is inserted more, the insertion operation of the flat latch 41 is guided while the first lever 210 does not rotate.

The operations of the protrusion 211 and the inclined part 212 will now be described.

When the flat latch 41 is inserted, the insertion end portion of the flat latch 41 comes in contact with the protrusion 211 at the same time with the insertion operation of the flat latch 41. Thus, the first lever 210 swiftly rotates around the hinge 112 in a clockwise direction. After the flat latch 41 is inserted by more than a predetermined depth and the monitor button 151 is off, the flat latch 41 comes in contact with the inclined part 212. Thus, the flat latch 41 is guided to the inclined part 212 and is inserted, while the first lever 210 does not rotate.

When the flat latch 41 is released, the flat latch 41 is supported by the inclined part 212 before it is released by less than a predetermined depth, such that the first lever 210 does not rotate. Thus, the monitor button 151 maintains the off state due to the first lever 210. After the flat latch 41 is released by more than a predetermined distance, since the end portion of the flat latch 41 comes in contact with the protrusion 211, the flat latch 41 is guided close to the protrusion 211, while the releasing operation of the flat latch 41 is performed. Of course, the first lever 210 rotates in a counterclockwise direction and the monitor button 151 is off.

In other words, when the flat latch 41 is inserted, it swiftly comes in contact with the protrusion 211 such that the monitor switch 150 is rapidly off. Meanwhile, when the flat latch 41 is released, the flat latch 41 is supported by the inclined part 212, such that the monitor switch 150 maintains the on state for such a long time.

Like the first lever 210, the second lever 230 is in a hingedly fixed state and the rotational operation is performed by the hook latch 42 inserted into the hook latch inserting opening 132. The second lever 230 includes three extension parts, that is, an operation part 231, an upper protrusion 232 and a lower protrusion, which are extended around the hinge 113.

In more detail, the operation part 231 comes in contact with the hook latch 42 and is urged upwards, such that the second lever 230 is rotated as a whole. Due to the rotation of the second lever 230, the upper protrusion 232 and the lower protrusion 233 are rotated at the same time. The upper protrusion 232 comes in contact with the circuit button 161 of the primary switch 160 and controls the on/off operation of the circuit button 161. The lower protrusion 233 comes in contact with the circuit button 171 of the secondary switch 170 and controls the on/off operation of the circuit button 171. Also, after the hook latch 42 is completely inserted, the insertion end portion of the hook latch 42 is latched to the latch board 50, thereby preventing the self-opening of the door.

The latch board's operation of opening/closing the door will now be described in detail.

First, if the door is closed, the flat latch 41 and the hook latch 42 are inserted into the latch holes 18 of the front plate 15. Then, the flat latch 41 and the hook latch 42 are inserted into the latch board 100 through the flat latch inserting opening 131 and the hook latch inserting opening 132 of the tight contacting part 130, respectively.

Then, the flat latch 41 comes in contact with the protrusion 211 of the first lever 210 and urges the protrusion 211 upwards. Due to this operation, the first lever 210 rotates in a clockwise direction. Also, the hook latch 42 inserted together with the flat latch 41 urges the operation part 231 of the second lever 230 upwards. Due to this operation, the second lever 230 rotates in a clockwise direction.

Meanwhile, due to the protrusion 211, the first lever 210 operates before the second lever 230. Accordingly, due to the pressing part 213 of the first lever 210, the monitor button 151 of the monitor switch 150 is pressed before the circuit buttons 161 and 171 of the circuit switches 160 and 170.

Since the operation part 231 is urged upwards, the upper protrusion 232 and the lower protrusion 233 move downwards and thus the circuit buttons 161 and 171 of the primary switch 160 and the secondary switch 170 are pressed at the same time.

The flat latch 41 is guided and slid by the inclined part 212 of the first lever 210. Likewise, the inclined part 212 of the first lever 210 is supported by the upper end portion of the flat latch 41. When the flat latch 41 is guided by the inclined part 212, the original position of the first lever 210 is supported without rotation. Also, the hook latch 42 supports the lower end portion of the operation part 231 of the second lever 230.

As described above, the difference in operation time of the monitor switch 150 and the circuit switches 160 and 170 may be increased by the protrusion 211 and the inclined part 212. According to a test, in case the door was closed, when the protrusion 211 and the inclined part 212 were not formed, the difference in operation time of the monitor switch 150 and the circuit switches 160 and 170 was 0.0056 second. However, when the protrusion 211 and the inclined part 212 were formed, the difference in operation time was 0.0128 second. That is, it could be observed that the difference in operation time was increased as much as 0.0072 second. Of course, other conditions, such as the closing time of the door, were tested in the same state according to the presence/absence of the protrusion 211 and the inclined part 212.

Accordingly, the monitor switch 150 is turned on faster than the circuit switches 160 and 170 by 0.0072 second. Like this, if the switching time is controlled, the current applied to the circuit switches 160 and 170 does not almost flow through the monitor switch 150, thereby obtaining the stability and reliability of the drive circuits of the microwave oven. For example, even when the user closes the door strongly, the current applied to the circuit switches 160 and 170 does not almost flow through the monitor switch 150.

A relationship between the operation of opening the door of the microwave oven and the operation of the switches 150, 160 and 170 will now be described. In the case of opening the door, the hook latch 42 moves downwards and then the door is opened. Meanwhile, the operation of the monitor switch 150 and the circuit switches 160 and 170 are opposite to the case of closing the door.

In more detail, if the second lever 230 rotates in a counterclockwise direction due to the release of the hook latch 41, the upper and lower protrusions 232 and 233 of the second lever 230 move upwards. Accordingly, due to the simultaneous restoration of the circuit buttons 161 and 171 of the circuit switches 160 and 170, the circuit switches 160 and 170 are turned off. Like this, the circuit switches 160 and 170 are turned off before the monitor switch 150. It is because the circuit switches 160 and 170 directly turn off the circuit buttons 161 and 171 in association with the release of the hook latch, while the monitor switch 150 can operate after the flat latch 41 is completely released downwards.

When the flat latch 41 is released, it moves along the inclined part 212 and the protrusion 211 of the first lever 210 in sequence. In other words, the first lever 210 can be returned downwards only after it escapes the inclined part 212 and the protrusion 211. Thus, the counterclockwise rotation of the first lever 210 is delayed as much as the duration when the flat latch 41 is supported by the inclined part 212. Also, the first lever 210 operates later than the second lever 230. Of course, if the counterclockwise rotation of the first lever 210 is delayed, the on operation of the monitor button 151 is also delayed as much.

A test was carried out so as to prove the above result. From the test, it was observed that the difference in operation time of the monitor switch 150 and the circuit switches 160 and 170 was increased in the opening of the door. In other words, under the same conditions, the difference in operation time is 0.0224 second when the protrusion part 211 and the inclined part 212 are absent. However, when the protrusion 211 and the inclined part 212 were present, the difference in operation time was 0.0388 second. That is, it was observed that the difference in operation time was increased as much as 0.0114 second.

Accordingly, it can be seen that the circuit switches 160 and 170 are turned off faster than the monitor switch 150 by 0.0114 second. In this case, since the time difference for which the current flowing through the circuit switches 160 and 170 does not flow through the monitor switch 150 is large, the microwave oven can operate more stably. For example, even when the user opens the door strongly, the monitor switch 150 is turned on after the circuit switches 160 and 170 are stably turned off. Therefore, the current does not flow from the circuit switches 160 and 170 to the monitor switch 150, and the vice versa. Also, the current does not flow between the circuit switches 160 and 170.

As described above, when the door is closed, the monitor switch operates before the circuit switches. Meanwhile, when the door is opened, the monitor switch operates after the circuit switches. In other words, the difference in operation time of the switches are increased as much. Thus, the influence between the circuits is reduced such that the microwave oven operates more stably.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

According to the present invention, in the opening/closing of the door, the current does not flow between the monitor switch and the circuit switch and also between the primary switch and the secondary switch. Thus, it is possible to prevent the internal circuits of the microwave oven from being shorted.

In addition, since the short circuit is prevented, the circuits of the microwave oven can maintain the normal state such that the microwave oven operates stably.

The invention claimed is:

1. A microwave oven, comprising:

a cavity configured to receive food loaded therein;

a door configured to open and close a front side of the cavity;

at least one latch formed at an inner side of the door;

a latch board configured to support the latches at least one latch when the at least one latch is inserted thereinto;

a monitor switch and a circuit switch, provided on the latch board, that perform on and off operations to control the microwave oven;

a first lever having one end configured to contact the monitor switch and the other end configured to contact the at least one latch, the first lever rotating to turn on or off the monitor switch;

a second lever having one end configured to contact the circuit switch and the other end configured to contact the at least one latch, the second lever rotating to turn on or off the circuit switch; and a protrusion part formed at a periphery of the first lever that protrudes from a portion with which the at least one latch comes in contact, such that when the at least one latch is inserted into the latch board, the monitor switch operates before the circuit switch, and when the at least one latch is released, the monitor switch operates after the circuit switch, wherein the at least one latch comprises a latch configured to contact the first lever and a latch configured to contact the second lever and wherein the latch configured to contact the first lever is a flat latch and the latch configured to contact the second lever is a hook latch.

2. The microwave oven according to claim 1, wherein the second lever includes three branches branched from a rotational center in three directions.

3. The microwave oven according to claim 1, further comprising an inclined part formed at the periphery of the first lever, the periphery extending from the protrusion part, wherein the inclined part fixes a position of the first lever when the flat latch is inserted into the latch board.

4. The microwave oven according to claim 1, wherein the monitor and circuit switches are hingedly fixed to the latch board.

5. The microwave oven according to claim 1, wherein the protrusion part is integrally formed with the first lever.

6. The microwave oven according to claim 1, wherein the latch board is tightly contacts a rear side of a front frame.

7. The microwave oven according to claim 1, wherein the circuit switch is provided with a primary switch and a secondary switch, which are turned on or off at the same time.

8. The microwave oven according to claim 1, wherein the first lever is formed in a triangular shape.

9. The microwave oven according to claim 1, wherein the first lever is formed in a triangular shape, the first lever having a first edge acting as a rotational center, a second edge acting as the protrusion part, and a third edge acting as a pressing part configured to contact the monitor switch.

10. The microwave oven according to claim 1, wherein the first lever is formed in an approximately triangular shape and is rotated by a hinge, and wherein the hinge is provided at an edge thereof.

11. A microwave oven, comprising:

a cavity configured to receive food loaded therein;

a door configured to open/close a front side of the cavity;

at least one latch formed at an inner side of the door;

a latch board configured to support the at least one latch when the at least one latch is inserted thereinto;

a monitor switch and a circuit switch, provided on the latch board, that perform on and off operations to control the microwave oven;

a first lever having one end configured to contact the monitor switch and the other end configured to contact the at least one latch, the first lever rotating to turn on or off the monitor switch;

a second lever having one end configured to contact the circuit switch and the other end configured to contact the at least one latch, the second lever rotating to turn on or off the circuit switch; and a protrusion part formed at a periphery of the first lever that protrudes from a portion with which the at least one latch comes in contact, such that when the at least one latch is inserted into the latch board, the monitor switch operates before the circuit switch, and when the at least one latch is released, the monitor switch operates after the circuit switch, wherein the second lever includes three branches branched from a rotational center in three directions.

12. A microwave oven, comprising:

a cavity configured to receive food loaded therein;

a door configured to open/close a front side of the cavity;

at least one latch formed at an inner side of the door;

a latch board configured to support the at least one latch when the at least one latch is inserted thereinto;

a monitor switch and a circuit switch, provided on the latch board, that perform on and off operations to control the microwave oven;

a first lever having one end configured to contact the monitor switch and the other end configured to contact the at least one latch, the first lever rotating to turn on or off the monitor switch;

a second lever having one end configured to contact the circuit switch and the other end configured to contact the at least one latch, the second lever rotating to turn on or off the circuit switch;

a protrusion part formed at a periphery of the first lever that protrudes from a portion with which the at least one latch comes in contact, such that when the at least one latch is inserted into the latch board, the monitor switch operates before the circuit switch, and when the at least one latch is released, the monitor switch operates after the circuit switch; and an inclined part formed at the periphery of the first lever, the periphery extending from the protrusion part, wherein the inclined part fixes a position of the first lever when the at least one latch is inserted into the latch board.

13. A microwave oven, comprising:

a cavity configured to receive food loaded therein;

a door configured to open/close a front side of the cavity;

at least one latch formed at an inner side of the door;

a latch board configured to support the at least one latch when the at least one latch is inserted thereinto;

a monitor switch and a circuit switch, provided on the latch board, that perform on and off operations to control the microwave oven;

a first lever having one end configured to contact the monitor switch and the other end configured to contact the at least one latch, the first lever rotating to turn on or off the monitor switch;

a second lever having one end configured to contact the circuit switch and the other end configured to contact the at least one latch, the second lever rotating to turn on or off the circuit switch; and a protrusion part formed at a periphery of the first lever that protrudes from a portion with which the at least one latch comes in contact, such that when the at least one latch is inserted into the latch board, the monitor switch operates before the circuit switch, and when the at least one latch is released, the monitor switch operates after the circuit switch, wherein the circuit switch is provided with a primary switch and a secondary switch, which are turned on or off at the same time.

* * * * *